US005421470A

United States Patent [19]

Dudzik

[11] Patent Number: 5,421,470

[45] Date of Patent: Jun. 6, 1995

[54] CAP FOR SEALING A CONTAINER

[75] Inventor: Henryk Dudzik, Mansfield, United Kingdom

[73] Assignee: Lawson Mardon Sutton Ltd., Sutton-in-Ashfield, United Kingdom

[21] Appl. No.: 108,716

[22] PCT Filed: Feb. 21, 1992

[86] PCT No.: PCT/GB92/00315

§ 371 Date: Oct. 12, 1993

§ 102(e) Date: Oct. 12, 1993

[87] PCT Pub. No.: WO92/15495

PCT Pub. Date: Sep. 17, 1992

[30] Foreign Application Priority Data

Mar. 6, 1991 [GB] United Kingdom ..... 9104704

[51] Int. Cl.[6] ..... B65D 53/00

[52] U.S. Cl. ..... 215/350; 215/343; 215/354

[58] Field of Search ..... 215/341, 343, 350, 354

[56] References Cited

U.S. PATENT DOCUMENTS

| | | | |
|---|---|---|---|
| 3,370,732 | 2/1968 | La Vange | 215/354 |
| 3,568,871 | 3/1971 | Livingston | 215/354 |
| 3,788,510 | 1/1974 | Collins | 215/354 X |
| 3,979,004 | 9/1976 | Bertario | 215/354 X |
| 4,238,042 | 12/1980 | Hatakeyama et al. | 215/343 X |
| 4,261,475 | 4/1981 | Babiol | 215/341 |
| 4,379,512 | 4/1983 | Ohmi et al. | 215/343 X |
| 4,386,712 | 6/1983 | De Wallace . | |
| 4,803,031 | 2/1989 | Ochs . | |
| 5,050,754 | 9/1991 | Marino | 215/256 |

FOREIGN PATENT DOCUMENTS

| | | |
|---|---|---|
| 2041559 | 1/1971 | France . |
| 1199131 | 7/1970 | United Kingdom . |

*Primary Examiner*—Allan N. Shoap
*Assistant Examiner*—Stephen Cronin
*Attorney, Agent, or Firm*—Haugen and Nikolai

[57] ABSTRACT

A cap (20) is provided with a sealing pad (31) made of good barrier material for the contents of a bottle on which the cap is engaged. The pad has annular projections (33, 34) which sealingly engage with the inner wall (13) and the rim (15) respectively of a mouth of the bottle. The pad is retained in the cap by a retaining ring (30) projecting radially inwardly from the skirt (22) of the cap and this ring engages the outer wall (14) of the mouth to provide a third seal between the cap and the bottle.

9 Claims, 3 Drawing Sheets

CAP FOR SEALING A CONTAINER

This invention relates to a cap sealingly engageable with a container.

The invention is especially useful in relation to the storage of chemicals.

Materials are available for the manufacture of caps economically, for this purpose, the caps having high resistance to corrosion by chemicals. Some grades of polyethylene are well suited to this purpose.

There is a problem, however, in that such materials tend to be too resilient and there is a risk of the cap coming away from a container under the pressure caused when the container is dropped.

It is also important to provide a good seal of the cap in the region of the rim of the mouth of the container, to prevent leakage. It is usual to seal a wad in the cap to the top of the container rim using induction heating techniques. This provides a good seal until the cap has been opened, but the problem of adequate re-sealing then exists.

This form of sealing also creates other problems. It is necessary to cut the wad, which is fixed to the rim of the container, sometimes by means of a cutter in the cap. These often fail to operate successfully and a knife or other implement is often used to open the seal. This substantially increases the risk of spillage or of spreading of the contents of the container by the implement.

A further problem is that a part of the wad, which contains a metal for the induction sealing operation, remains attached to the container. This prevents recycling of the material of the container, due to this contamination.

The primary object of the present invention is to provide a cap having a wad which provides a good non-leakable seal, without the need for induction sealing, the cap being replaceable on the container, after opening, so as to reinstate the non-leakable seal.

It is known to provide caps having wads with resilient annular seals to seal with the rim region of a container, but these have not been adequate for use with dangerous chemicals.

U.S. Pat. No. 4,386,712 discloses a cap having a wad provided with an annular plug for sealing in a container mouth. An annular projection around the plug seals on the top face of the rim of the container. This construction requires accurate matching of the plug to the container, which is difficult to achieve given usual manufacturing tolerances. There is, therefore, risk of the plug fitting too loosely, or of fitting too tightly, so that spillage is likely in trying to remove the cap. The secondary seal is only operative, if the cap is tightly screwed down.

U.S. Pat. No. 3,788,510 also discloses a plug-fitting wad with a wrap-around portion which can be squeezed onto the top surface of the container rim and also squeezed between the skirt of the cap and a recessed outer side wall of the container. This suffers even more from the necessity for accurate dimensioning of the cap, wad and container. There is a risk that, if the wad is slightly overlarge relative to the recess, the wad will not seal properly, or may be damaged. Tight screwing down of the cap would be essential to ensure that a seal was achieved.

GB-A-1199131 also discloses a wad provided with a plug. The wad also has an annular sealing member which seals with a recessed top surface of the container and a ribbed portion which seals on the top surface of the rim of the container. During sealing of the container, the plug is severed from the rest of the wad.

Opening of the container, therefore, is hazardous, since the plug has to be removed from the container as a separate operation. If, as is taught, this is discarded, an inadequate seal remains, if the cap is reapplied.

In all of these prior art documents, and as is well known in the art, the skirt of the cap has an annular projection to retain the wad in the cap.

The present invention avoids the problems of all of these prior art proposals and permits easy removal of the cap and reclosing of the container without loss of the original sealing ability.

The present invention provides a container and cap assembly in which the container comprises a mouth provided with an inner wall, an outer wall and an intervening rim between the walls, and in which the cap comprises a top and a peripheral skirt, the skirt and the outer wall having engagement means for rotational engagement of the cap on the container with accompanying axial movement of the top towards the mouth, there being provided a resilient sealing wad retained in the cap by a retaining ring formed by an annular inner projection of the skirt between said engagement means and the top of the cap, the wad being engageable by the cap for holding the sealing wad in sealing engagement with the rim, the wad having an annular inner sealing projection and an annular outer sealing projection spaced from and surrounding the inner sealing projection, the projections extending away from the top for sealingly engaging the inner wall and the rim, respectively, of the container, characterised in that the outer wall of the inner sealing projection has a circumferential convex portion resiliently radially urged into sealing contact with the inner wall of the mouth of the container, the outer sealing projection has an inner wall resiliently urged into sealing contact with the outer edge of the rim of the container, and the retaining ring is a deformable member resiliently engaging the outer wall of the mouth of the container, so as to provide a third peripheral seal.

A triple seal is, therefore, formed, in which the necessity to manufacture to close tolerances is avoided. The cap can easily be removed and re-used without risk of spillage and with the original sealing ability being restored.

The cap and the wad are preferably made of different grades of polyethylene, with the wad being more resilient than the cap. This feature facilitates recycling of the used caps without the need to separate the wad from the cap.

Preferably, the annular outer sealing projection has its free end portion resiliently urged into sealing contact with the skirt of the cap. This feature provides a fourth seal, improving the overall sealing quality of the assembly. In addition, however, this feature prevents back flow of the container contents to the space between the and the cap. This can occur during removal of the container if it is not held upright and can lead to leakage from the cap.

The invention also resides in a cap and sealing wad for use in the assembly with the container.

Reference is now made to the accompanying drawings, wherein.

Figure 1:
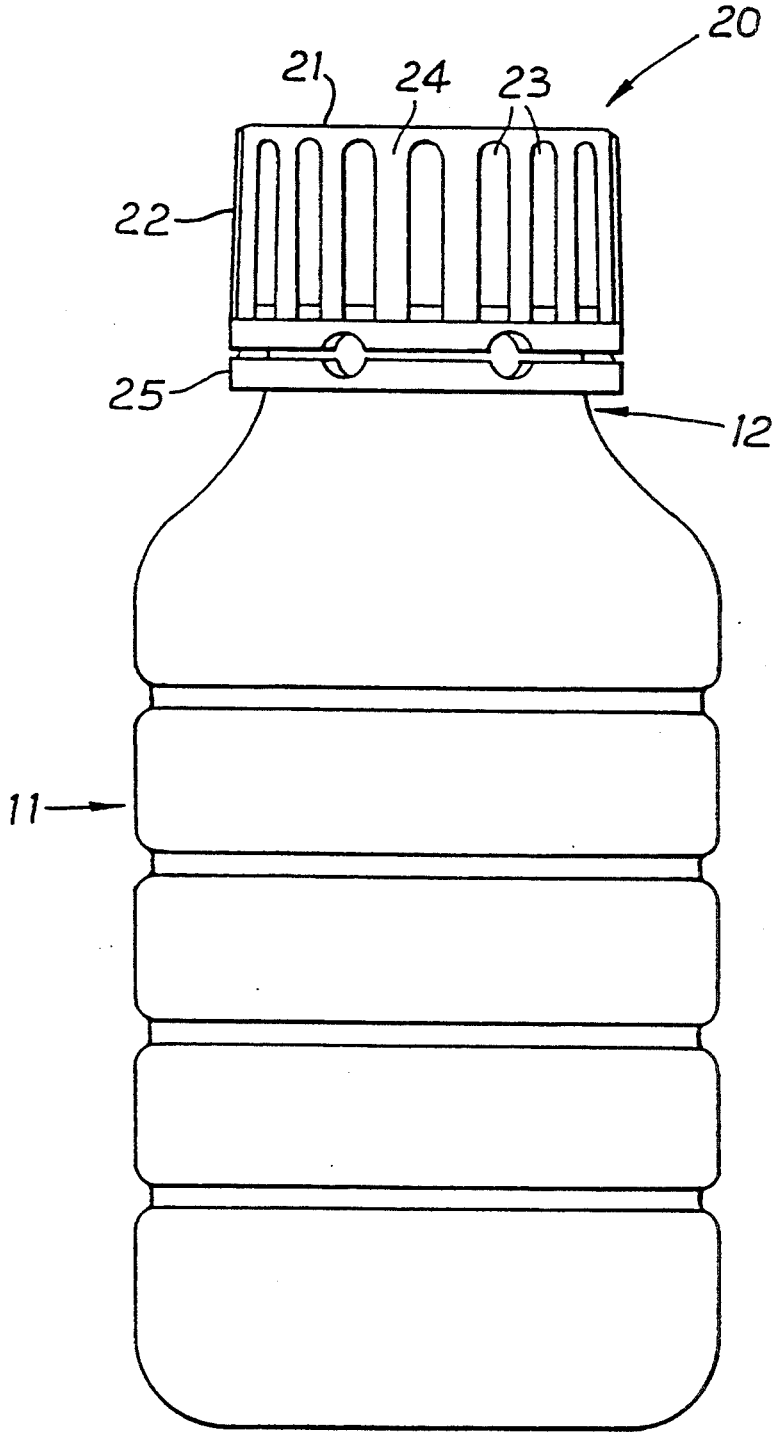
FIG. 1 is a side elevation of a container and cap assembly according to the invention.
Figure 2:
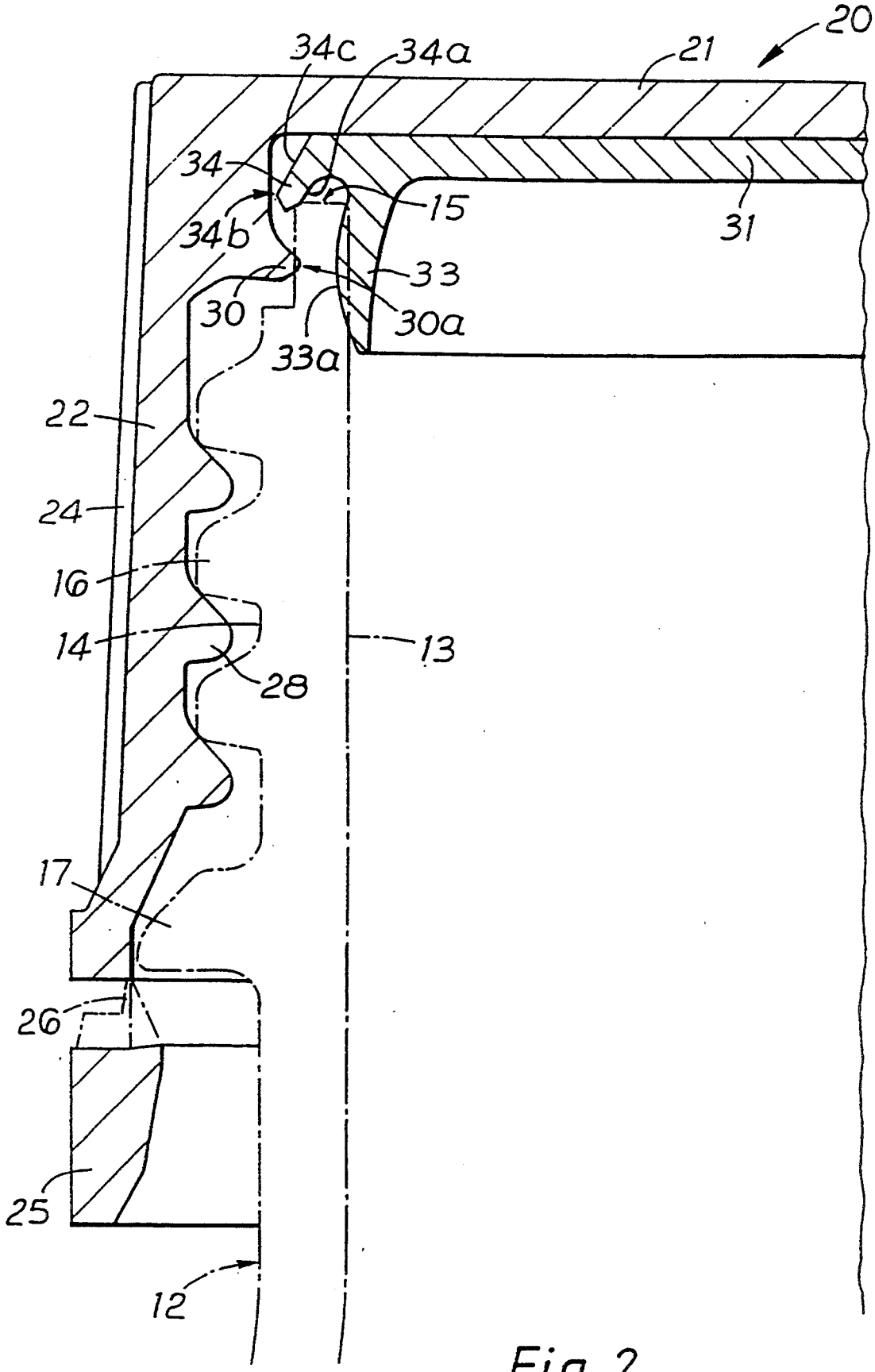
FIG. 2 is a sectional view of a part of the cap with the container indicated in dash-lines.

The container shown is a bottle 11 moulded from plastics material such as p.e.t. and having a neck 12. The neck is provided with a mouth having an internal wall 13, an external wall 14, and an intervening rim 15 (FIG. 2). The external wall is provided with screw threads 16 and with a peripheral collar 17. The container is of conventional design.

The cap 20 shown has a top 21 and a peripheral skirt 22. The external wall of the skirt is provided with alternating axial channels 23 and ribs 24 to facilitate manual grip of the cap. A tamper-evident-band 25 is also provided. As shown in FIG. 2, the band 25 is joined to the skirt 22 by spaced, frangible webs 26, in known manner, and the band is captivated on the neck 12 of the bottle 11 by means of the collar 17. The skirt has internal screw threads 28, which engage the threads 16 on the bottle. The band and the collar are designed so that, when the cap is screwed down, the band passes over the collar, whereas when the cap is screwed off the bottle, the band engages the collar and causes breaking of the frangible webs.

Between the screw threads 28 of the skirt and the top 21 of the cap, the skirt 22 is provided with an annular retaining ring 30. The ring is of generally elongate triangular section and tapers away from the skirt. The ring extends radially into resilient engagement with the outer wall 14 of the mouth of the bottle. The ring is resiliently deformed, in use, to provide a pressure seal **30*a* with the outer wall 14**.

A sealing wad 31 is provided and is retained adjacent the top 21 of the cap by the retaining ring 30. The wad is made of a material which is both more resilient and a better chemical barrier material than the cap 20. The materials for the wad and the cap may be different grades of polyethylene.

Figure 3:
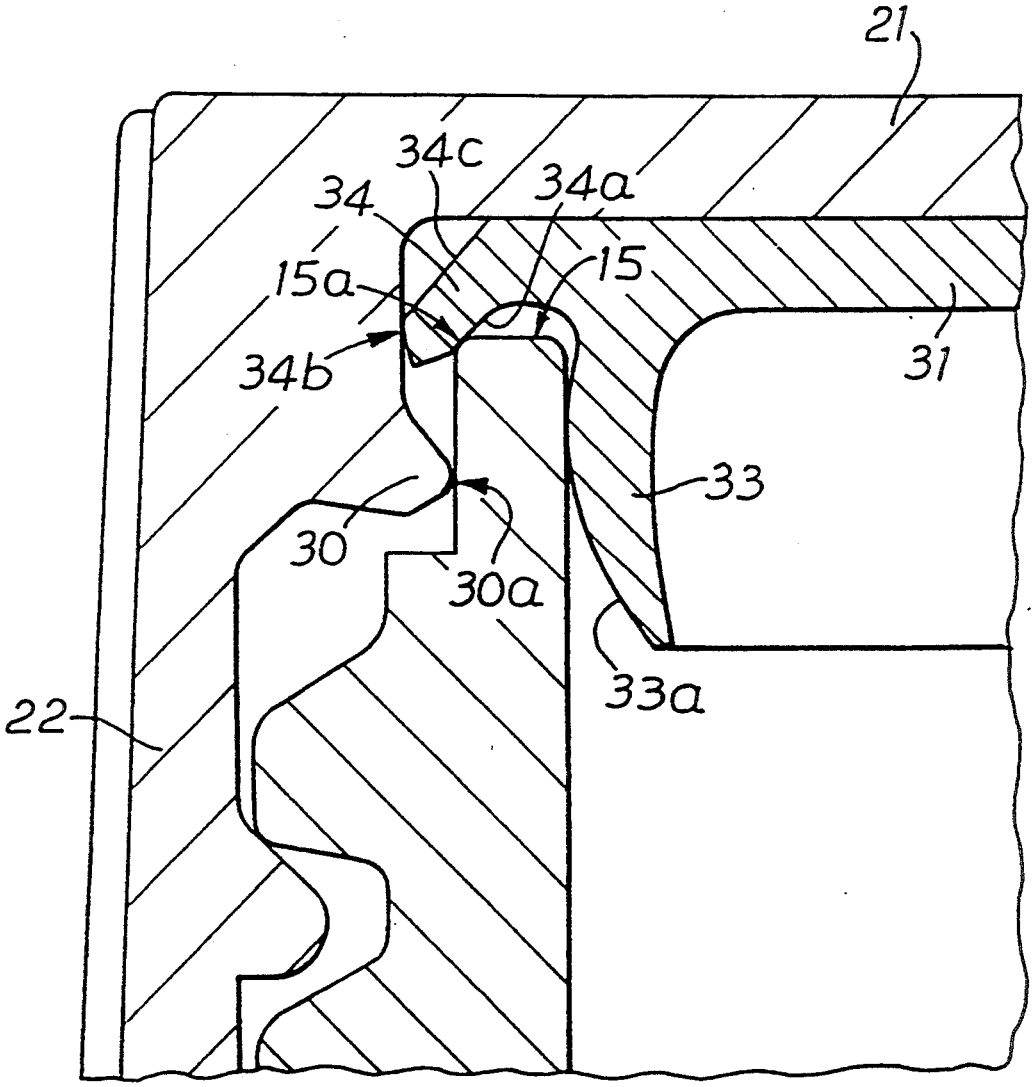
FIG. 3 is an enlarged sectional view with the cap assembled on the container.

The wad is provided with radially inner and outer annular projections 33, 34 which extend away from the top 21. The inner projection 33 is longer than the outer projection 34 and has a convexly shaped outer surface **33*a* for resiliently, sealingly engaging the inner wall 13 of the mouth of the bottle. The outer projection 34 extends outwardly at an acute angle to the top 21 and has an inner wall 34*a* resiliently urged into sealing engagement with the outer edge 15*a* of the rim 15** of the mouth of the bottle. Both projections are shown in the as-moulded state in FIG. 2, but FIG. 3 shows the projections resiliently deformed, in use, in engagement with the mouth.

The arrangement, therefore provides three pressure seals, all of which allow for tolerances in manufacture. All of the seals are edge seals so that undue force in opening or closing the container is avoided.

To facilitate mounting of the wad in the cap, the outer projection 34 has an outer wall acutely angled to the cap axis. A tapered surface is thereby provided, which together with the flexibility of the projection enables the wad to pass the retaining ring 30.

In the embodiment disclosed, the outer projection 34 has its outer edge **34*b* at the free end engaged with the inner surface of the skirt. In use, as the cap is screwed down, this edge 34*b* is urged into sealing engagement with the skirt by lever action of the outer projection 34 on the edge 15*a*** of the mouth of the container.

This fourth seal prevents back flow of liquid between the wad and the cap, if any liquid should spill into the cap during opening of the container.

I claim:

1. A container and cap assembly comprising:

(a) a container having a mouth and a sidewall, the sidewall further having an inner wall surface, an outer wall surface and an intervening sidewall rim therebetween;

(b) a cap comprising a top and a peripheral skirt;

(c) wherein said skirt and said outer wall surface have engagement means for rotational engagement of the cap on the container with accompanying axial movement of the top towards the mouth and said skirt further comprises retaining ring formed by an annular inner projection between said engagement means and the top of the cap;

(d) resilient sealing wad means retained in the cap by said retaining ring means, the sealing wad means further being engageable by the cap to hold the wad means in sealing engagement with the sidewall rim, the wad means having an annular inner sealing projection and an annular outer sealing projection spaced from and surrounding the inner sealing projection, the projections extending away from the top of the cap to sealingly engage the inner wall surface and an outer edge of the sidewall rim, respectively, of the container;

(e) wherein the inner sealing projection of the wad means has an outer wall characterized by a circumferential convex portion to be resiliently radially urged into sealing contact with the inner wall surface of the mouth of the container;

(f) wherein the outer sealing projection of the wad means has an inner wall to be resiliently urged into sealing contact with said outer edge of the sidewall rim proximate the outer wall of the container; and (g) wherein the retaining ring is a deformable member resiliently engaging the outer wall surface of the mouth of the container, thereby providing with said inner and outer sealing projections of said sealing wad means three peripheral seals.

2. An assembly according to claim 1, wherein the cap and the wad are made of different grades of polyethylene with the sealing wad being made of material more resilient than that of the cap.

3. An assembly according to claim 1, wherein the annular outer sealing projection has its free end portion resiliently urged into sealing contact with the skirt of the cap.

4. An assembly according to claim 2, wherein the annular outer sealing projection has its free end portion resiliently urged into sealing contact with the skirt of the cap.

5. An assembly according to claim 1, wherein the retaining ring is of generally elongate triangular section.

6. An assembly according to claim 2, wherein the retaining ring is of generally elongate triangular section.

7. An assembly according to claim 3, wherein the retaining ring is of generally elongate triangular section.

8. An assembly according to claim 4, wherein the retaining ring is of generally elongate triangular section.

9. A self-sealing container cap for engaging and sealing a mouth of a container. The container further having a sidewall, the sidewall having an inner wall surface and an outer wall surface and defining an intervening sidewall rim therebetween, said cap comprising:

(a) a top and a peripheral skirt, the skirt having internal engagement means permitting rotational engagement with the mouth of the container with accompanying axial movement of the top towards the mouth and an inner retaining ring provided on the skirt between the top and the engagement means;

(b) a resilient sealing-wad retained in the cap by said inner retaining ring, the wad having an annular inner sealing projection and an annular outer sealing projection spaced from and surrounding the inner sealing projection, the projections extending away from the top for sealingly engaging the inner wall surface and an outer edge of the sidewall rim, respectively, of the container;

(c) wherein the inner sealing projection has an outer surface comprising a circumferential convex portion for engaging the inner wall surface of the mouth of the container;

(d) wherein the outer sealing projection has an inner wall extending at an acute angle to the skirt for engaging the outer edge of the sidewall rim proximately the outer wall of the container; and (e) wherein the retaining ring is elongate and resilient and extends radially inwardly of the cap for resiliently engaging and forming a seal with the outer wall of the mouth of the container.

* * * * *